United States Patent [19]

Ochiai et al.

[11] Patent Number: 4,505,036

[45] Date of Patent: Mar. 19, 1985

[54] ELECTRIC SHAVER ARRANGED TO BE TILTED

[75] Inventors: Masahiko Ochiai; Yoshinori Taito, both of Nogata, Japan

[73] Assignee: Kyushu Hitachi Maxell, Ltd., Fukuoka, Japan

[21] Appl. No.: 474,039

[22] Filed: Mar. 10, 1983

[30] Foreign Application Priority Data

Mar. 15, 1982 [JP] Japan ..... 57-36697[U]
Mar. 16, 1982 [JP] Japan ..... 57-37753[U]

[51] Int. Cl.[3] ..... B26B 19/10
[52] U.S. Cl. ..... 30/34.1; 30/89
[58] Field of Search ..... 30/34.1, 87, 89

[56] References Cited

U.S. PATENT DOCUMENTS 3,783,508 1/1974 Brown ..... 30/34.1
3,797,109 3/1974 Yamada ..... 30/89
3,844,035 10/1974 Bauerle ..... 30/43.92
3,889,371 6/1975 de Boer ..... 30/34.1

FOREIGN PATENT DOCUMENTS 751625 7/1980 U.S.S.R. ..... 30/87

*Primary Examiner*—Jimmy C. Peters
*Attorney, Agent, or Firm*—Birch, Stewart, Kolasch & Birch

[57] ABSTRACT

An electric shaver of a vibration type which includes a shaver head portion or upper casing having a movable blade and a screen blade, and arranged to be tilted with respect to a main casing of the shaver, and a trimmer unit adapted to be projected from the main casing in a direction opposite to the tilting direction of the shaver head portion for facilitation of trimming of hair.

3 Claims, 9 Drawing Figures

ELECTRIC SHAVER ARRANGED TO BE TILTED

BACKGROUND OF THE INVENTION

The present invention generally relates to a shaver and more particularly, to an electric shaver of a vibration type, in which a shaver head portion or upper casing including an inner blade or movable blade and a stationary outer blade or screen blade, is arranged to be pivotable or tilted with respect to a shaver main casing provided, for example, with a trimmer unit.

Generally, electric shavers of the above described type are considered to be convenient for use, since the angle of shaving blades with respect to skin may be adjusted by tilting the shaver head portion, and there has conventionally been proposed an electric shaver of this kind in which the shaver head portion is arranged to be held in a position inclined at a predetermined angle for stability thereof during use. In the electric shaver as described above, a screen blade holder is detachably mounted with respect to the shaver head portion for convenience in cleaning of cut hair and replacement of the screen blade, with a lock means being further provided for maintaining the locked state of the screen blade holder.

In the conventional electric shavers of the above described type, however, since a tilting or inclination angle holding means i.e. positioning means for the shaver head portion and the lock means for the screen blade holder are separately provided respectively, there has been experienced the disadvantage that the number of parts involved and man hours required for assembly, etc. are undesirably increased. Meanwhile, in the known electric shaver equipped with a trimmer unit, such a trimmer unit is not necessarily convenient for actual use, owing to the construction of the electric shaver. Moreover, in the electric shaver provided, for example, with a pushbutton switch for turning on or off the power supply to the shaver, there is experienced the drawback that, although such a pushbutton may be readily operated by a finger tip, it tends to be erroneously actuated due to unexpected contact thereof with other items, while being carried about or during storage.

SUMMARY OF THE INVENTION

Accordingly, an essential object of the present invention is to provide an improved electric shaver of a vibration type in which a shaver head portion or upper casing having a movable blade and a screen blade is arranged to be pivotable or tiltable with respect to a shaver main casing.

Another important object of the present invention is to provide an electric shaver of the above described type, which is further provided with a trimmer unit built in the shaver main casing for facilitation of trimming, in cooperation with the tilting arrangement of the shaver head portion.

A further object of the present invention is to provide an electric shaver of the above described type, in which a pushbutton switch for turning on and off the power supply to the shaver is provided with a lock means for preventing erroneous functioning of the electric shaver.

Still another object of the present invention is to provide an electric shaver of the above described type which is simple in construction and accurate in functioning, and can be readily manufactured on a large scale at low cost.

In accomplishing these and other objects, according to one preferred embodiment of the present invention, there is provided an electric shaver which comprises a main casing, an upper casing including a shaving movable blade and a screen blade holder detachably attached onto the upper casing, with the upper casing being coupled to the main casing for pivotal movement between a first position directed in parallel to an axis of the main casing and a second position inclined at a predetermined angle with respect to the axis of the main casing, a vibrating member arranged to be vibrated in one unit with the shaving movable blade and provided in the upper casing, a vibration driving means and a driving means for the vibration driving means which are provided in said main casing, means for positioning the upper casing at the first and second positions, and means for locking the screen blade holder on the upper casing, a trimmer unit arranged to be projectable from or retractable into the main casing through pivotal movement of the trimmer unit so as to be projected in a direction opposite to the direction of the pivotal movement of the upper casing towards the second position intersecting at right angles with the vibrating direction of the shaving movable blade.

The vibrating member is engaged with the vibrating driving member so as to be slidable in the direction of the pivotal movement of the upper casing for tilting towards the second position, while the vibration driving member is provided with an engaging portion which is engageable with or disengageable from an engageable portion provided on a movable blade of the trimmer unit, following the pivotal movement of the trimmer unit for the projection and retraction.

The electric shaver further includes a pushbutton mounted on part of the outer surface of the main casing, and a power on/off switch provided on the main casing and associated with the pushbutton so as to be operated through depression of said pushbutton, and a sliding type knob provided on the outer surface of the main casing so as to be slidable in a direction intersecting at right angles with the depressing direction of the pushbutton. The sliding type knob is provided with a locking piece moving in one unit with the sliding type knob for selective engagement with or disengagement from a connecting portion between the pushbutton and the power on/off switch.

By the arrangement according to the present invention as described above, an improved electric shaver has been advantageously presented, with substantial elimination of disadvantages inherent from the conventional electric shavers of this kind.

BRIEF DESCRIPTION OF THE DRAWINGS

These and other objects and features of the present invention will become apparent from the following description taken in conjunction with the preferred embodiments thereof as referenced by the accompanying drawings, in which.

DETAILED DESCRIPTION OF THE INVENTION

Figure 1:
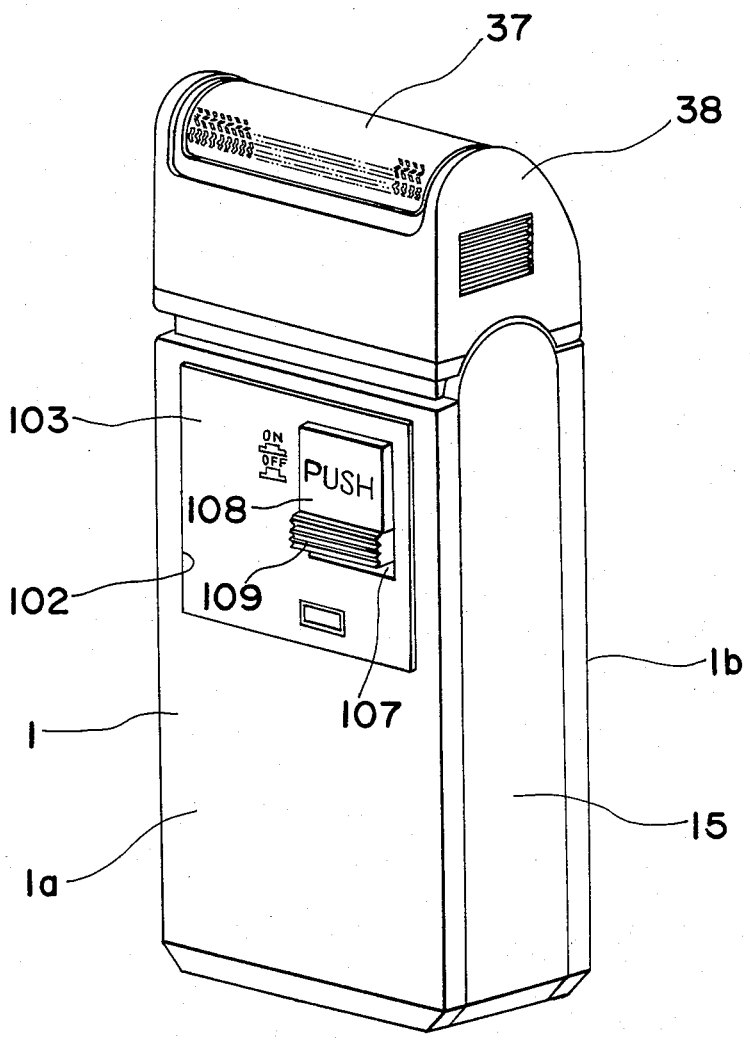
FIG. 1 is a perspective view of an electric shaver according to one preferred embodiment of the present invention as viewed from a front side thereof provided with a pushbutton.

Before the description of the present invention proceeds, it is to be noted that like parts are designated by like reference numerals throughout the accompanying drawings.

Figure 2:
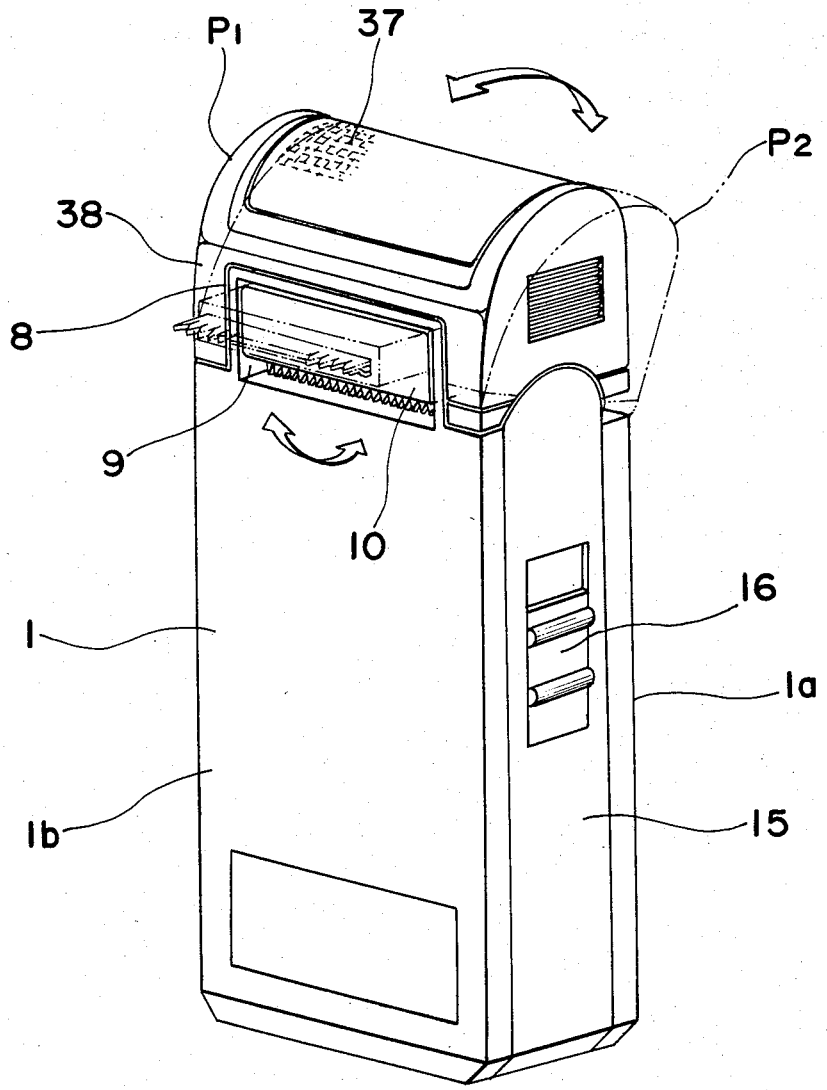
FIG. 2 is a view similar to FIG. 1, which particularly shows a rear side thereof provided with a trimmer unit.
Figure 3:
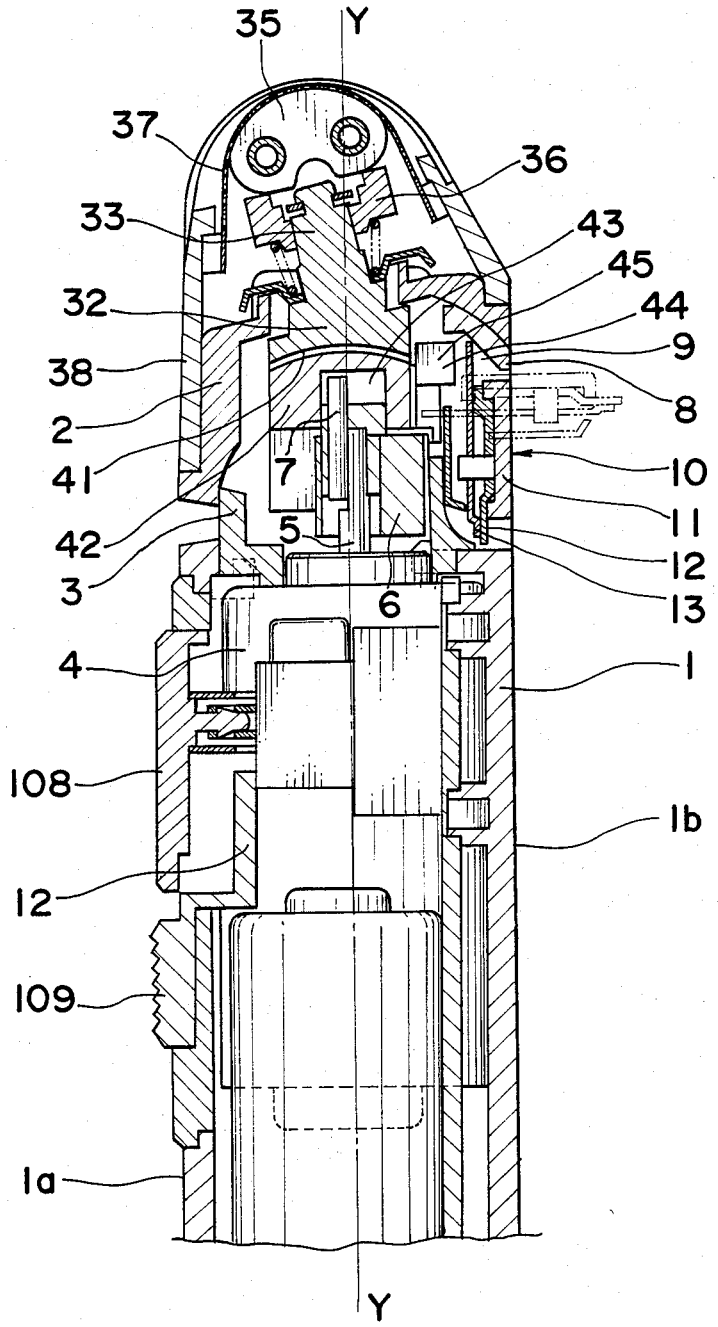
FIG. 3 is a fragmentary side sectional view of the electric shaver of FIG. 1.
Figure 4:
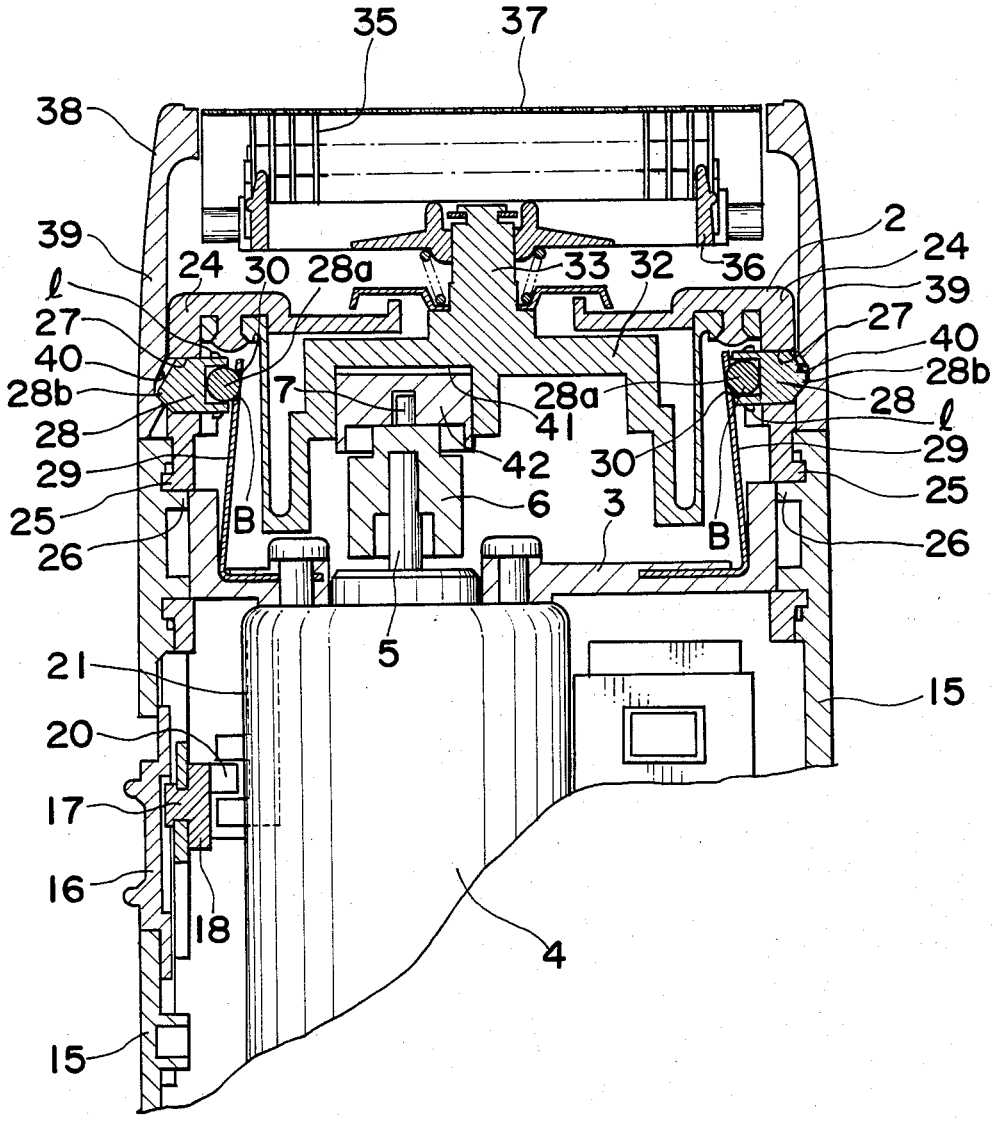
FIG. 4 is a fragmentary sectional view, on an enlarged scale, of the upper front portion of the electric shaver of FIG. 1, FIG. 5(*a*) is an exploded perspective view of a screen blade holder, an upper case, and engaging pieces, employed in the electric shaver of FIG. 1, FIG. 5(*b*) is an exploded perspective view of a vibrating member, a vibration driving member, a trimmer unit, a mounting base and an electric motor employed in the arrangement of FIG. 1.
Figure 5A:
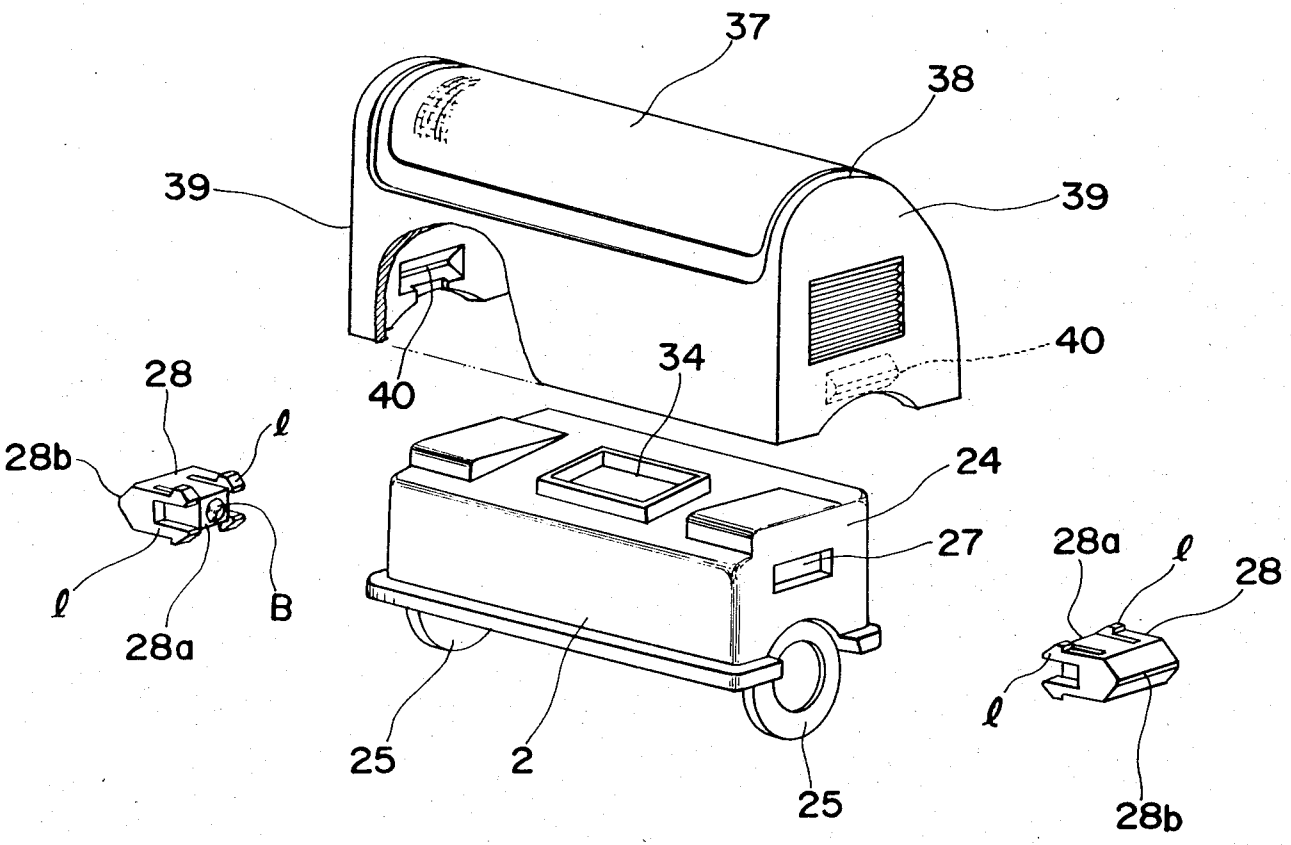
Figure 5:
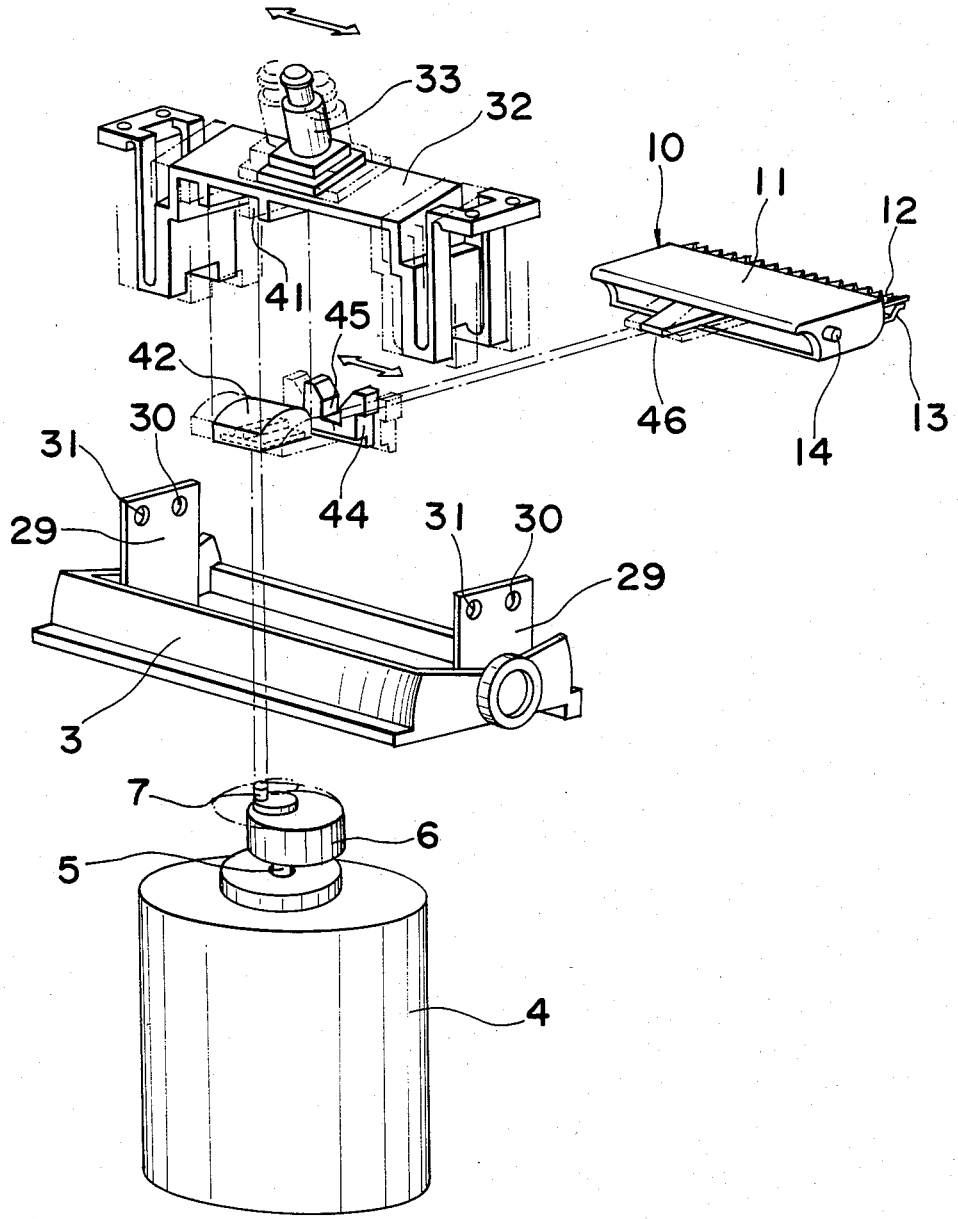

Referring now to the drawings, there is shown, in FIGS. 1 through 5(*b*), an electric shaver of a vibration type according to one preferred embodiment of the present invention, which generally includes a main casing 1 of a rectangular box-like configuration having a front wall 1*a*, a rear wall 1*b*, side walls 15 and a bottom wall, and an upper casing 2 (FIGS. 5(*a*) and 5(*b*)) pivotally mounted on an upper portion of the main casing 1 for rotational movement between a first position P1 directed straight upwards in a direction parallel to an axis of the main casing 1 and indicated by solid lines, and a second position P2 tilted at a predetermined angle with respect to the axis of the main casing 1 towards the front wall 1*a* of the main casing 1 as shown in chain lines in FIG. 2.

More specifically, as shown in FIGS. 3, 4, 5(*a*) and 5(*b*), the main casing 1 further includes a mounting base 3 secured at its upper portion, a motor 4 mounted at the lower portion of the mounting base 3, an eccentric cam 6 fixed to a shaft 5 of the motor 4 extending upwardly through the mounting base 3, and an eccentric pin 7 provided on the eccentric cam 6 so as to project upwardly therefrom. Meanwhile, in a wall 8 extending upwardly from the upper portion of the rear wall 1*b* of the main casing 1 at the back of the mounting base 3, there is formed a cut out portion 9, into which a trimmer unit 10 is fitted.

The trimmer unit 10 includes a blade holder 11, a stationary blade 12 and a movable blade 13 which are supported by the blade holder 11, and support pins 14 extending laterally outwardly from opposite ends of the blade holder 11 (FIG. 5(*b*)), and thus, the trimmer unit 10 is pivotally supported within the cut out portion 9 through the support pins 14 for movement between a retracted position parallel to and flush with the surface of the wall 8 of the main casing 1 and a projected position directed in a direction at right angles with respect to the surface of the wall 8. In an outer surface of one side wall 15 of the main casing 1, an operating knob 16 is slidably fitted for vertical movement along the axis of the main casing 1 for selective projection or retraction of the trimmer unit 10 as described earlier. More specifically, as shown in FIG. 6, a pin 19 projecting from the operating knob 16 is engaged with a bifurcated portion 18*a* formed at one end of a rocking plate 18 pivotally supported about a shaft 17 within the side wall 15 of the main casing 1, and a pin 20 provided at the other end of the rocking plate 18 is engaged with a groove 22 formed at a lower end of an operating lever 21 supported for vertical movement within the main casing 1, while a hook 21*a*provided at an upper end of the operating lever 21 is engaged with an L-shaped receiving portion 23 formed at one end of the blade holder 11 of the trimmer unit 10 in an attitude for the retraction.

Figure 6:
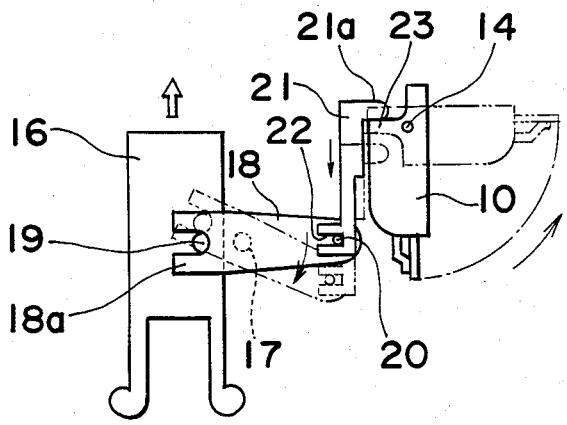
FIG. 6 is a schematic diagram explanatory of a projection/retreat operating mechanism for the trimmer unit, FIG. 7(*a*) is a fragmentary side sectional view of an upper portion of the electric shaver of FIG. 1 showing the state where the shaving head is operated, and FIG. 7(*b*) is a view similar to FIG. 7(*a*), which particularly shows the state of operation of the trimmer unit.

By the above arrangement, upon upward sliding movement of the operating knob 16, the operating lever 21 is pulled down through the rocking plate 18, and thus, the trimmer unit 10 is pivoted upwardly about the pins 14 through approximately 90° as shown by chain lines in FIGS. 3 and 6 so as to be projected rearwardly from the outer surface of the wall 8 of the main casing 1. Conversely, if the operating knob 16 is slid downwardly, the operating lever 21 is pushed up through the rocking plate 18, and the trimmer unit 10 is pivoted downwardly about the support pins 14 so as to be brought into the retracted position shown by solid lines in FIGS. 3 and 6.

Subsequently, means for positioning the upper casing 2 at the first position P1 and the second position P2, and means for locking the screen blade holder 38 on the upper casing 2 will be described hereinbelow.

The upper casing 2 has boss portions 25 (FIGS. 4 and 5(*a*)) formed in its opposite side walls 24, and the boss portions 25 are fitted onto corresponding boss portions 26 formed on upper inner portions of the opposite side walls 15 of the main casing 1, so that the upper casing 2 may be rotated back and forth about the boss portions 26. In this embodiment, the upper casing 2 is arranged to be positionally changed over in two stages, between the first or neutral position P1 where its axis is located on the axis Y—Y of the main casing 1 (FIGS. 2 and 3) and the second or tilted position P2 where its axis is inclined with respect to the axis Y—Y of the main casing 1 at an angle of about 15° towards the front wall 1*a* of the main casing 1, and the positioning means for the above purpose is provided between the upper casing 2 and the mounting base 3 described earlier.

More specifically, the upper casing 2 has rectangular openings 27 formed in the corresponding side walls 24 thereof (FIG. 5(*a*)), while engaging pieces 28 each having an outer end 28*b* of a triangular cross section and an inner end 28*a* provided, for example, with a detent ball B, are respectively fitted into the rectangular openings 27 of the upper casing 2 at the outer end 28*b* thereof. Each of the engaging pieces 28 is further formed with resilient retaining pieces l on corner portions thereof at its inner end 28*a* for engagement with the peripheral inner edge of the rectangular opening 27 of the upper casing 2. The detent balls B at the inner ends 28*a* of the respective engaging pieces 28 are adapted to contact under pressure, corresponding outer faces of resilient plates 29 extending upwardly from opposite side portions of the mounting base 3 (FIG. 5(*b*)), while each of the resilient plates 29 is formed with rotation restricting openings or recesses 30 and 31 in two positions on an imaginary circle (not shown) drawn with respect to the boss portion 26 as a center.

Meanwhile, the screen blade holder 38 holding the screen blade 37 for sliding contact with the movable blade 35 is detachably mounted over the upper casing 2, and has side walls 39 confronting the outer faces of the corresponding side walls 24 of the upper casing 2, and is provided with retaining recesses 40 formed in the inner faces of the respective side walls 39 thereof for releasably receiving therein the outer ends 28*b* of the engaging pieces 28 described earlier.

In the above arrangement, the upper casing 2 including the screen blade 37 and movable blade 35, may be pivoted in the forward and backward directions as described earlier. In the state where the upper casing 2 is in the first or neutral position P1 located on the axis Y—Y of the main casing 1 (FIGS. 2 and 3), the detent balls B at the inner ends 28*a* of the engaging pieces 28 engage the rotation restricting openings 31 of the resilient plates 29 at the side of the main casing 1 so as to retain the upper casing 2 at the first neutral position P1. For tilting the upper casing 2 forwardly from the first neutral position P1 to the second tilted position P2, the upper casing 2 is rotated forwardly about the boss portions 26, and following the above rotation, the detent balls B at the inner ends 28*a* of the engaging pieces 28 are disengaged from the rotation restricting openings 31 for subsequent engagement with the other rotation restricting openings 30 so as to retain the upper casing 2 in the second tilted position P2.

On the other hand, the screen blade holder 38 is retained in the state where it is mounted on the upper casing 2 by the engagement of the retaining recesses 40 thereof with the outer ends 28*b* of the engaging pieces 28 urged outwardly by the resiliency of the resilient plates 29. For detaching the screen blade holder 38 from the upper casing 2, the screen blade holder 38 is pulled upwardly for sliding the retaining recesses 40 thereof over the outer ends 28*b* of the engaging pieces 28 for once displacing said engaging pieces 28 inwardly. Meanwhile, for application of the screen blade holder 38, the holder 38 is fitted over the upper casing 2 from above so as to once depress the outer ends 28*b* of the engaging pieces 28 inwardly at the lower ends of the side walls 39 of the holder 38, and upon coincidence of the retaining recesses 40 with the outer ends 28*b* of the engaging pieces 28, the engaging pieces 28 are pushed out by the resiliency of the resilient plates 29 for automatic engagement of the outer ends 28*b* thereof with the retaining recesses 40.

Inside the upper casing 2, there is provided in a suspended manner, a vibrating member 32, for example, of a plastic material, subjected to oscillation through elastic deformation in lateral directions, while a pin 33 projecting upwardly from the upper surface of the vibrating member 32 in a forwardly inclined state, is arranged to extend through a central opening 34 of the upper casing 2, with a holder 36 for the movable blade 35 being connected to the pin 33.

In the under surface of the vibrating member 32, a concave groove 41 having an arcuate cross section is formed in the back and forth direction of the main casing 1, and in the concave groove 41, a vibration driving member 42, for example, of a plastic material having an convex arcuate cross section is slidably engaged. The vibration driving member 42 as described above has an elongated groove 43 formed in its under surface in the back and forth direction of the main casing 1, with the eccentric pin 7 described earlier being receiving in said groove 43. The vibration driving member 42 is also provided with a V-shaped block 44 integrally formed at its rear face so as to provide an engaging portion 45 at a V-shaped groove of the block 44. An engageable portion 46 in a lug shape extending from the movable blade 13 of the trimming unit 10 is arranged to engage the engaging portion 45 of the block 44 when the trimmer unit 10 is in the projected state, and to disengage from the engaging portion 45 when the trimmer unit 10 is in the retracted state.

By the above construction, upon rotation of the eccentric cam 6 through driving by the motor 4, the vibration driving member 42 engaged with the eccentric pin 7 of the cam 6 is subjected to reciprocating vibration in the lateral direction for the vibration of the vibrating member 3 in that direction, by which vibration, the movable blade 35 is also subjected to the lateral reciprocating vibration for sliding cohtacting with the inner face of the screen blade 37.

Figure 7:
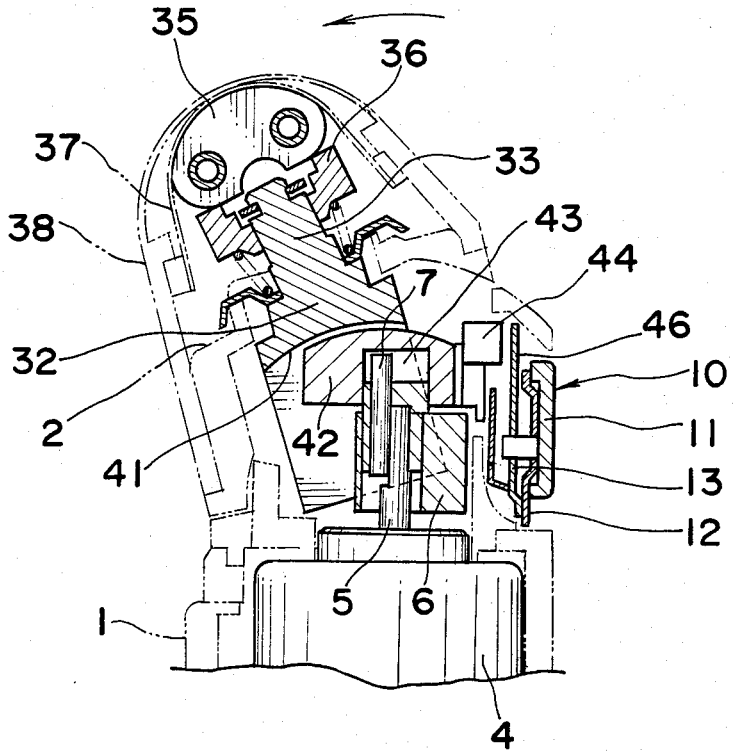
Figure 7B:
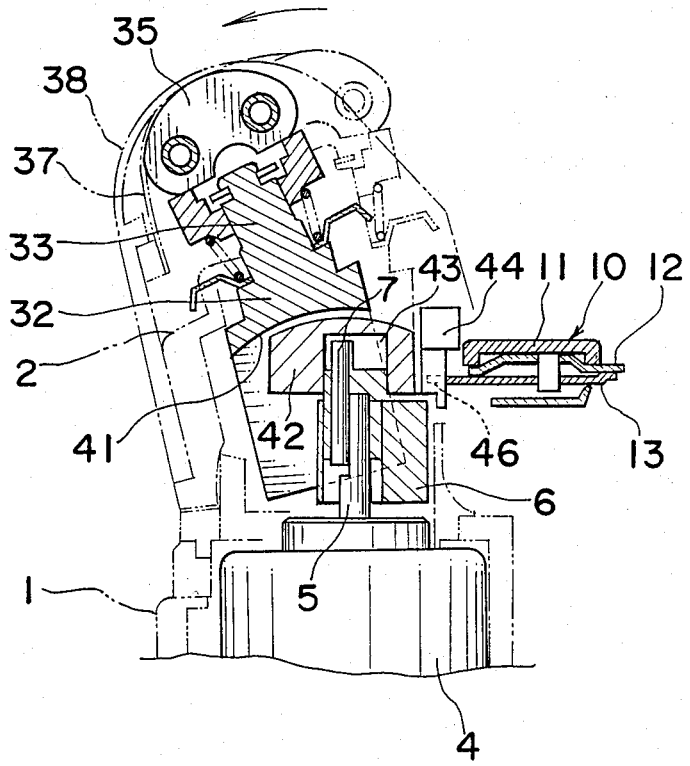

In FIGS. 3 and 7(*a*) both showing the states of the electric shaver ready for shaving, the trimmer unit 10 is kept retracted into the wall 8 of the main casing 1. FIG. 3 shows the state where the upper casing 2 is in the first neutral position P1 without being tilted forwardly, while FIG. 7(*b*) illustrates the state where the upper casing 2 is inclined forwardly into the second tilted position P2, and either of the above states may be selected as desired according to portions to be shaved or convenience for users. It is to be noted here that, in the embodiment described so far, although the upper casing 2 is arranged to be inclined forwardly towards the second position P2 through the angle of about 15° with respect to the main casing 1, such inclination angle may be altered and set as desired according to the requirements so far as the vibration driving member 42 is held in engagement with the concave groove 41 of the vibrating member 32 at all times.

For effecting the trimming, the upper casing 2 is inclined forwardly into the second tilted position P2 as shown in FIG. 7(*b*), while the trimmer unit 10 is caused to project out of the main casing 1 in a direction opposite to the inclination of the upper casing 2, and by the above projection, the engageable portion 46 of the movable blade 13 engages the engaging portion 45 of the vibration driving member 42 for driving of the movable blade 13 of the trimmer unit 10. It is to be noted that, when the engaging portion 45 is formed into the configuration of the V-shaped groove as in the embodiment described so far, the engageable portion 46 may be kept engaged with the corresponding engaging portion 45, even when the vibration driving member 42 is positionally deviated in the lateral direction from the position of the engageable portion 46 of the trimmer unit 10, and that the motor 4 as the driving device may, of course, be replaced, for example, by an electro-magnet or the like, and also, that the tilting of the upper casing 2 is not limited to the two stages as described in the foregoing, but may be arranged to be effected through a plurality of stages.

As is clear from the foregoing description, according to the present invention, the engaging pieces 28 are fitted into the openings 27 formed in the tiltable upper casing 2, while the inner and outer ends 28*a* and 28*b* of the engaging pieces 28 are respectively, releasably fitted into the rotation restricting openings 30 or 31 formed in the resilient plates 29, and also, into the retaining recesses 40 of the screen blade holder 48, so that the inclination angle is maintained for stability of the upper casing 2, while positive mounting and locking of the screen blade holder may be achieved. Accordingly, since the positioning means, i.e. inclination maintaining means for the upper casing 2 and the mounting and locking means for the screen blade holder 38 can be constituted only by two kinds of members, i.e. the engaging pieces 28 and the resilient plates 29 which may be simultaneously utilized for the both means, not only the assembly of the shaver is facilitated, but such engaging pieces 28 and the resilient plates 29 may be incorporated even into small spaces. Moreover, by the resilient plates 29 alone, the engaged state between the inner and outer ends 28*a* and 28*b* of the engaging pieces 28 and the rotational restriction openings 30 and 31, and also the retaining recesses 40, may be positively maintained at all times. Furthermore, for cleaning cut hair adhering to or accumulated on the movable blade 35 and the upper casing 2, the screen blade holder 38 contacting the outer ends 28*b* of the engaging pieces 28 is detached from the upper casing 2, and thus, the engaging pieces 28 are fully pushed outwardly by the resilient plates 29, with a consequent reduction of contact pressure of the resilient plates 29 with respect to the inner ends 28*a* of the engaging pieces 28. Therefore, the upper casing 2 which is rather difficult to hold due to detachment of the screen blade holder 38 may be tilted by a slight operating force for facilitation of the cleaning of cut hair.

Moreover, according to the present invention, since the upper casing 2 is arranged to be tiltable in the direction intersecting at right angles with the vibrating direction of the movable blade 35, and opposite to the projecting direction of the trimmer unit 10 with respect to the main casing 1, not only the angle of the movable blade 35 is adjusted as desired during shaving for improved handling convenience, but the trimming may be effected in a very efficient manner, since the upper casing 2 which would otherwise be a hindrance to trimming, may be tilted from the trimmer unit 10 as far as possible. Meanwhile, since the vibration driving member 42 having the engaging portion 45 arranged to be engaged with or disengaged from the engageable portion 46 of the trimmer unit 10 is adapted to be located at the side of the main casing 1 irrespective of the tilting of the upper casing 2, the engaging position between the vibration driving member 42 and the trimmer unit 10 is not altered even when the upper casing 2 is tilted, and thus, the trimming blades may be driven positively at all times.

Although the present invention has been fully described by way of example with reference to the accompanying drawings, it is to be noted here that various changes and modifications will be apparent to those skilled in the art. Therefore, unless otherwise such changes and modifications depart form the scope of the present invention, they should be construed as included therein.

What is claimed is:

1. An electric shaver which comprises a main casing (1), an upper casing (2) including a shaving movable blade (35) and a screen blade holder (38) detachably attached onto said upper casing (2), said upper casing (2) being coupled to said main casing (1) for pivotal movement between a first position (P1) directed in parallel to an axis of the main casing (1) and a second position (P2) inclined at a predetermined angle with respect to the axis of the main casing (1), a vibrating member (32) arranged to be vibrated in one unit with the shaving movable blade (35) and provided in said upper casing (2), a vibration driving means (42) and a driving means for the vibration driving means (42) which are provided in said main casing (1), means for positioning the upper casing (2) at said first and second positions (P1) (P2) and means for locking said screen blade holder (38) on said upper casing (2), and a trimmer unit (10) arranged to be projectable from or retractable into the main casing (1) through pivotal movement of said trimmer unit (10) so as to be projected in a direction opposite to the direction of the pivotal movement of said upper casing (2) towards said second position (P2) intersecting at right angles with vibrating direction of said shaving movable blade (35), said vibrating member (32) being engaged with said vibrating driving member (42) so as to be slidable in the direction of the pivotal movement of said upper casing (2) for tilting towards said second position (P2), said vibration driving member (42) being provided with an engaging portion (45) which is engageable with or disengageable from an engageable portion (46) provided on a movable blade (13) of the trimmer unit (10) following the pivotal movement of said trimmer unit (10) for the projection and retraction.

2. An electric shaver as claimed in claim 1, further including a pushbutton (108) mounted in part of an outer surface of the main casing (1), and a power on/off switch (105) provided in said main casing (1).

3. An electric shaver which comprises a main casing (1), an upper casing (2) including a shaving movable blade (35) and a screen blade holder (38) detachably attached onto said upper casing (2), said upper casing (2) being coupled to said main casing (1) for pivotal movement between a first position (P1) directed in parallel to an axis of the main casing (1) and a second position (P2) inclined at a predetermined angle with respect to the axis of the main casing (1), a vibrating member (32) arranged to be vibrated in one unit with the shaving movable blade (35) and provided in said upper casing (2), a vibration driving means (42) and a driving means for the vibration driving means (42) which are provided in said main casing (1), means for positioning the upper casing (2) at said first and second positions, and means for locking said screen blade holder (38) on said upper casing, (2) said upper casing positioning means and said screen blade holder locking means include engaging pieces (28) each having inner ends (28*a*), and outer ends (28*b*) which are fitted into openings (27) foraed in side walls (24) of said upper casing (2) in positions deviated from the rotational center of said upper casing (2) so as to be movable towards inner and outer sides of the openings (27) and retained in the direction toward said openings (27), said outer ends (28*b*) of the respective engaging pieces (28) extending out of said openings (27) being arranged to be engageable with or disengageable from retaining recesses (40) formed in side walls (39) of said screen blade holder (38) to be positioned adjacent to outer sides of side walls (24) of said upper casing (2), following attaching or detaching of said screen blade holder (38) onto said upper casing (2), said inner ends (28*a*) of said engaging pieces (28) projecting inwardly from said openings (27) being arranged to be slidable over outer surfaces of resilient plates (29) which rise from said main casing (1) so as to confront inner sides of said side walls (24) of said upper casing (2), and also to be engageable with or disengageable from rotational angle restricting recesses (30) or (31) formed in said resilient plates (29), following pivotal movement of said upper casing (2).

* * * * *